US011478833B2

(12) United States Patent
Yonekura et al.

(10) Patent No.: US 11,478,833 B2
(45) Date of Patent: Oct. 25, 2022

(54) CROSSBOW CORRECTION DEVICE, MOLTEN METAL PLATING FACILITY, AND CROSSBOW CORRECTION METHOD

(71) Applicant: PRIMETALS TECHNOLOGIES JAPAN, LTD., Hiroshima (JP)

(72) Inventors: Takashi Yonekura, Hiroshima (JP); Masao Tambara, Hiroshima (JP); Masashi Yoshikawa, Hiroshima (JP)

(73) Assignee: PRIMETALS TECHNOLOGIES JAPAN, LTD., Hiroshima (JP)

( * ) Notice: Subject to any disclaimer, the term of this patent is extended or adjusted under 35 U.S.C. 154(b) by 281 days.

(21) Appl. No.: 16/478,767

(22) PCT Filed: Feb. 20, 2017

(86) PCT No.: PCT/JP2017/006203
§ 371 (c)(1),
(2) Date: Jul. 17, 2019

(87) PCT Pub. No.: WO2018/150585
PCT Pub. Date: Aug. 23, 2018

(65) Prior Publication Data

US 2020/0047234 A1 Feb. 13, 2020

(51) Int. Cl.
*B21D 1/00* (2006.01)
*B21C 51/00* (2006.01)
*B65H 23/34* (2006.01)

(52) U.S. Cl.
CPC ..... *B21D 1/00* (2013.01); *B21C 51/00* (2013.01); *B65H 23/34* (2013.01)

(58) Field of Classification Search
CPC .... B21D 1/00; B21D 1/02; C23C 2/26; B65H 23/34; B05C 3/125
(Continued)

(56) References Cited

U.S. PATENT DOCUMENTS

2009/0175708 A1* 7/2009 Lofgren ..... C23C 2/40 414/222.02
2017/0009326 A1 1/2017 Yonekura et al.

FOREIGN PATENT DOCUMENTS

CN 106337157 A 1/2017
JP 2002-317259 A 10/2002
(Continued)

OTHER PUBLICATIONS

International Search Report for PCT/JP2017/006203 dated Apr. 25, 2017.
(Continued)

*Primary Examiner* — Adam J Eiseman
*Assistant Examiner* — Bobby Yeonjin Kim
(74) *Attorney, Agent, or Firm* — Birch, Stewart, Kolasch & Birch, LLP

(57) ABSTRACT

A crossbow correction device 16 for correcting crossbow of a steel strip S by a magnetic force during conveyance includes a plurality of electromagnets 57*a* to 57*d*, 67*a* to 67*d* arranged in a strip width direction of the steel strip S and facing each other so as to sandwich the steel strip S in a strip thickness direction, a moving mechanism 51 to 54, 61 to 64 capable of moving the electromagnets 57*a* to 57*d*, 67*a* to 67*d* relative to the steel strip S, and a controller 17 configured to operate the moving mechanism 51 to 54, 61 to 64, based on a current value flowing through the electromagnets 57*a* to 57*d*, 67*a* to 67*d*.

9 Claims, 8 Drawing Sheets

(58) Field of Classification Search
USPC ..... 72/707
See application file for complete search history.

(56) References Cited

FOREIGN PATENT DOCUMENTS

| | | | | |
|---|---|---|---|---|
| JP | 2003-113460 | A | | 4/2003 |
| JP | 2003113460 | A | * | 4/2003 |
| JP | 2003-293111 | A | | 10/2003 |
| JP | 2003293111 | A | * | 10/2003 |
| JP | 2009114533 | A | * | 5/2009 |
| JP | 5632596 | B2 | | 11/2014 |
| KR | 20130120957 | A | * | 11/2013 |

OTHER PUBLICATIONS

Extended European Search Report dated Oct. 9, 2019 issued in corresponding European Application No. 17896782.4.
International Preliminary Report on Patentability dated Aug. 29, 2019 in corresponding International (PCT) Application No. PCT/JP2017/006203.
Office Action dated Jan. 28, 2021 issued in counterpart Chinese Application No. 201780086599.7 with English Machine Translation.

* cited by examiner

CROSSBOW CORRECTION DEVICE, MOLTEN METAL PLATING FACILITY, AND CROSSBOW CORRECTION METHOD

TECHNICAL FIELD

The present invention relates to a crossbow correction device for correcting crossbow of a steel strip, a molten metal plating facility including the crossbow correction device, and a crossbow correction method for correcting crossbow of a steel strip.

BACKGROUND ART

In a facility for producing a steel strip, a steel strip wound around multiple rolls travels continuously, and various treatment is performed on the continuous steel strip. The steel strip wound around multiple rolls deforms (warps) in the strip width direction due to contact with the rolls and tension, etc. Therefore, such a facility has a crossbow correction device for correcting the shape (crossbow) of the steel strip in the strip width direction.

For instance, in a molten metal plating facility immersing a steel strip in a molten metal for plating, a crossbow correction device is provided in the vicinity of a wiping nozzle for removing excess molten metal adhering to the surface of the steel strip. With this configuration, since a gas is sprayed by the wiping nozzle to the steel strip which has been leveled by the crossbow correction device, the gas is uniformly sprayed to the steel strip, and a metal plating layer is formed with uniform thickness.

The crossbow correction device is used for correcting the shape (crossbow) of a steel strip in the strip width direction by using magnetic force and includes a plurality of electromagnets arranged in the strip width direction of the steel strip and facing each other so as to sandwich the steel strip (see Patent Document 1, for instance).

The magnetic force of the electromagnets acts on portions of the steel strip facing the electromagnets and sucks (levels) the portions of the steel strip. That is, by the plurality of electromagnets arranged in the strip width direction of the steel strip, respective portions of the steel strip facing the electromagnets are sucked, and thereby crossbow of the steel strip is corrected as a whole. Here, a force to correct the shape of the steel strip by each electromagnet is proportional to the magnetic force of each electromagnet, i.e., the current value supplied to each electromagnet.

CITATION LIST

Patent Literature

Patent Document 1: JP5632596B

SUMMARY

Problems to be Solved

However, since the magnetic force of each electromagnet is controlled based on a distance sensor so that the steel strip is positioned at a central position or at a predetermined position in the vicinity of the center between opposite electromagnets, load applied to a part of the electromagnets arranged in the strip width direction of the steel strip (magnetic force generated in the part of electromagnets; current value applied to the part of electromagnets) may increase in accordance with the shape of the steel strip or pass line. Further, if the load applied to the part of electromagnets reaches maximum magnetic force which the electromagnets can generate, a problem arises in that crossbow of the steel plate cannot be corrected appropriately.

The present invention was made in view of the above problem, and an object thereof is to efficiently correct crossbow of a steel strip by electromagnets.

Solution to the Problems

To solve the above problem, a crossbow correction device according to the present invention for correcting crossbow of a steel strip by a magnetic force during conveyance comprises: a plurality of electromagnets arranged in a strip width direction of the steel strip and facing each other so as to sandwich the steel strip in a strip thickness direction; a moving mechanism capable of moving the electromagnets relative to the steel strip; and a controller configured to operate the moving mechanism, based on a current value flowing through the electromagnets.

To solve the above problem, a crossbow correction method according to the present invention for correcting crossbow of a steel strip by a magnetic force during conveyance comprises: arranging a plurality of electromagnets in a strip width direction while the plurality of electromagnets face each other so as to sandwich the steel strip in a strip thickness direction, and moving the electromagnets relative to the steel strip, based on a current value flowing through the electromagnets.

Advantageous Effects

With the crossbow correction device according to the present invention, it is possible to efficiently correct crossbow of a steel strip by electromagnets.

With the crossbow correction method according to the present invention, it is possible to efficiently correct crossbow of a steel strip by electromagnets.

DETAILED DESCRIPTION

Embodiments of the crossbow correction device according to the present invention will now be described in detail with reference to the accompanying drawings. In the embodiments described below, the crossbow correction device according to the present invention is adopted in a molten metal plating facility. It will, of course, be understood that the present invention is not limited to the following embodiments. For instance, the crossbow correction device according to the present invention may be adopted in other facilities for producing a steel strip, and various modifications can be made without departing from the spirit of the present invention.

First Embodiment

With reference to FIGS. 1 to 4, the configuration of the molten metal plating facility including the crossbow correction device according to the first embodiment of the present invention will be described.

Figure 1:
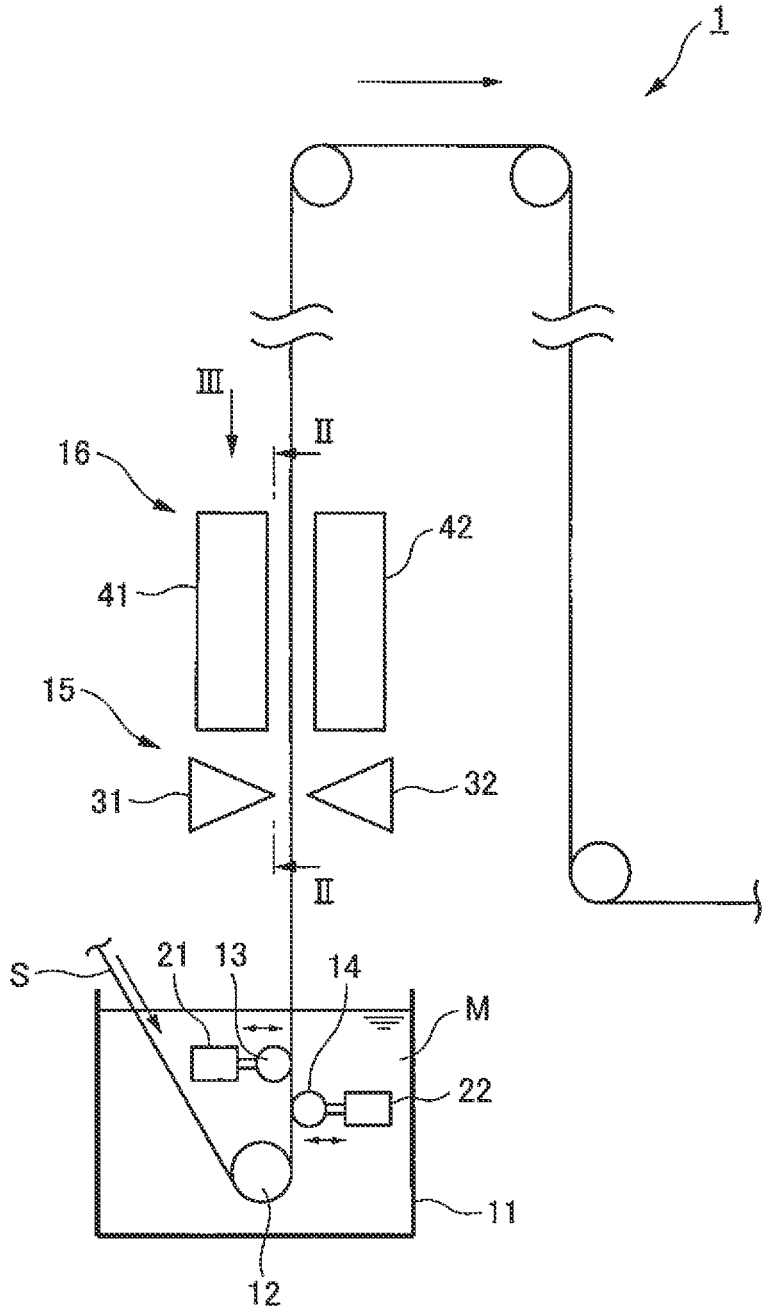
FIG. 1 is an explanatory diagram showing a structure of a molten metal plating facility according to the first embodiment.

As shown in FIG. 1, the molten metal plating facility 1 includes a plating bath 11 storing molten metal M. A steel strip S fed to the molten metal plating facility 1 travels through the plating bath 11 (molten metal M), so that the molten metal M adheres to the surface of the steel strip S.

In the plating bath 11, a sink roll 12 and a plurality of (two in FIG. 1) in-bath rolls 13, 14 rotatably supported are provided. The sink roll 12 is one of multiple rolls around which the steel strip S is wound, and the steel strip S is continuously fed by the multiple rolls, including the sink roll 12. The traveling direction of the steel strip S traveling through the plating bath 11 (molten metal M) is changed by the sink roll 12 so that the steel strip S travels upward in the substantially vertical direction (toward the upper side in FIG. 1).

The in-bath rolls 13, 14 are disposed downstream of the sink roll 12 in the strip feeding direction (above the sink roll 12 in the vertical direction; on the upper side in FIG. 1) so as to sandwich the steel strip S, i.e., so as to face a first surface (on the left side in FIG. 1) and a second surface (on the right side in FIG. 1) of the steel strip S respectively.

The in-bath rolls 13, 14 are mechanically connected to roll moving motors 21, 22 capable of moving and bring the in-bath rolls 13, 14 close to the steel strip S, respectively. In the molten metal plating facility 1, by moving the in-bath rolls 13, 14 by driving the roll moving motors 21, 22, it is possible to bring the in-bath rolls 13, 14 into contact with the steel strip S, and adjust the shape of the steel strip S in the strip width direction and the pass line of the steel strip S (feeding position).

A wiping nozzle 15 is disposed downstream of the in-bath rolls 13, 14 in the strip feeding direction (above the in-bath rolls 13, 14 in the vertical direction; on the upper side in FIG. 1) and adjusts the thickness of a metal plating layer formed on the surface of the steel strip S. The wiping nozzle 15 is mainly composed of a first nozzle unit 31 and a second nozzle unit 32 disposed so as to sandwich the steel strip S therebetween. The first nozzle unit 31 is disposed so as to face the first surface of the steel strip S, and the second nozzle unit 32 is disposed so as to face the second surface of the steel strip S.

The first nozzle unit 31 and the second nozzle unit 32 spray a predetermined gas to the steel strip S and thereby remove excess molten metal M adhering to the surface of the steel strip S. The thickness of the metal plating layer formed on the surface of the steel strip S in the molten metal plating facility 1 is adjusted by the distance of the steel strip S from the first nozzle unit 31 and the second nozzle unit 32 and the pressure of the gas sprayed to the steel strip S by the first nozzle unit 31 and the second nozzle unit 32.

A crossbow correction device 16 is disposed downstream of the wiping nozzle 15 in the strip feeding direction (above the wiping nozzle 15 in the vertical direction; on the upper side in FIG. 1) to correct the shape of the steel strip S. The crossbow correction device 16 is mainly composed of a first correction unit 41 and a second correction unit 42 disposed so as to sandwich the steel strip S therebetween. The first correction unit 41 is disposed (on a first side in the strip thickness direction of the steel strip S) so as to face the first surface of the steel strip S, and the second correction unit 42 is disposed (on a second side in the strip thickness direction of the steel strip S) so as to face the second surface of the steel strip S.

The first correction unit 41 and the second correction unit 42 apply magnetic forces to the steel strip S to correct the shape of the steel strip S in the strip width direction (crossbow correction, leveling) and suppress vibration of the steel strip S (damping).

Figure 2:
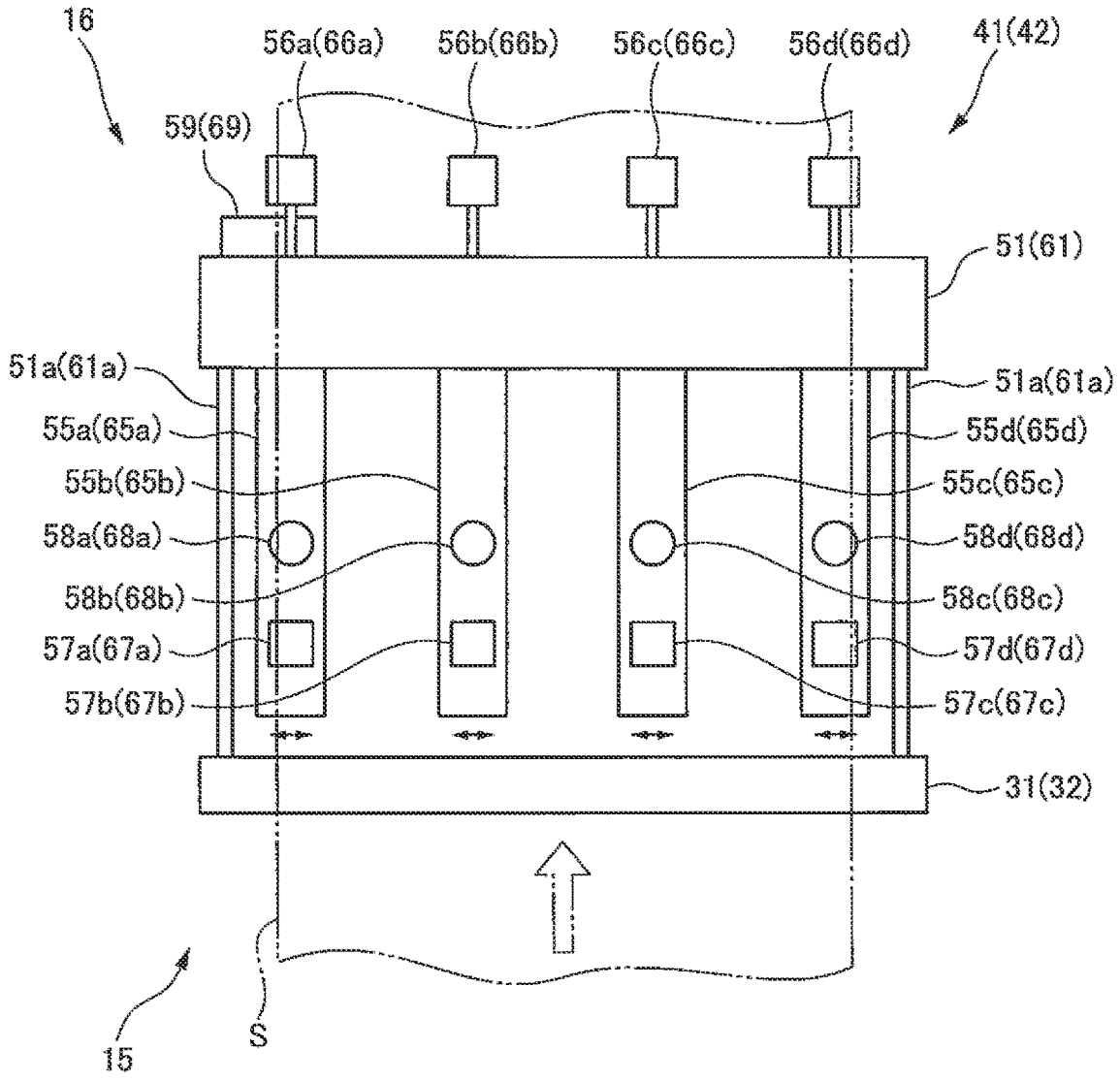
FIG. 2 is an explanatory diagram showing a structure of a crossbow correction device in a molten metal plating facility according to the first embodiment.
Figure 3:
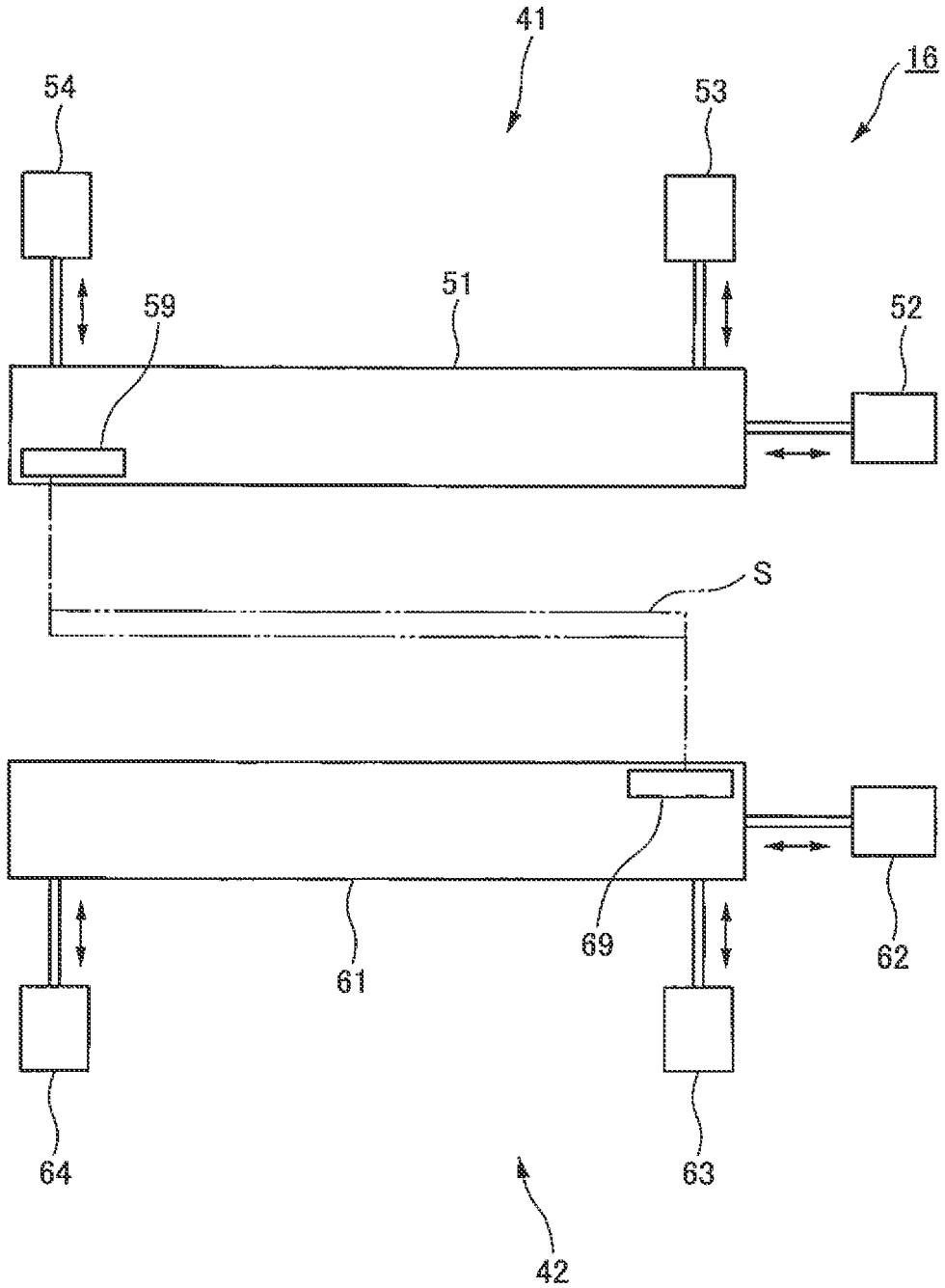
FIG. 3 is an explanatory diagram showing a structure of a crossbow correction device in a molten metal plating facility according to the first embodiment.

As shown in FIGS. 2 and 3, the first correction unit 41 is provided with a support frame (first support member) 51 facing the steel strip S and extending in the strip width direction (horizontal direction; right-left direction in FIG. 2) of the steel strip S. The support frame 51 is mechanically connected to a first frame moving motor 52, a second frame moving motor 53, and a third frame moving motor 54 capable of moving the support frame 51 relative to a structure not depicted, in a plane (horizontal plane) perpendicular to the feeding direction of the steel strip S.

As shown in FIG. 3, the first frame moving motor 52 is connected to a first end (right end in FIG. 3) of the support frame 51 and moves the support frame 51 in the strip width direction (right-left direction in FIG. 3) of the steel strip S. The second frame moving motor 53 is connected to the first end of the support frame 51 and moves the first end of the support frame 51 in the strip thickness direction (up-down direction in FIG. 3) of the steel strip S. The third frame moving motor 54 is connected to a second end (left end in FIG. 3) of the support frame 51 and moves the second end of the support frame 51 in the strip thickness direction of the steel strip S.

For instance, when the second frame moving motor 53 and the third frame moving motor 54 are driven in the same direction, the support frame 51 is translationally moved (shifted) in the strip thickness direction of the steel strip S in a plane (horizontal plane) perpendicular to the feeding direction of the steel strip; and when one of the second frame moving motor 53 or the third frame moving motor 54 is driven, or when the second frame moving motor 53 and the third frame moving motor 54 are driven in opposite directions, the support frame 51 is rotationally moved (skewed) in a plane (horizontal plane) perpendicular to the feeding direction of the steel strip.

As shown in FIG. 2, the support frame 51 has a plurality of (four in FIG. 2) moving blocks 55*a*, 55*b*, 55*c*, 55*d* arranged in the longitudinal direction of the support frame 51 (strip width direction of the steel strip S; right-left direction in FIG. 2) and extending below the support frame 51 (downward in the vertical direction). The plurality of moving blocks 55*a* to 55*d* are mechanically connected to a plurality of (four in FIG. 2) block moving motors 56*a*, 56*b*, 56*c*, 56*d* capable of moving the moving blocks 55*a* to 55*d* relative to the support frame 51 in the longitudinal direction, respectively.

Each of the block moving motors 56*a* to 56*d* is connected to the corresponding moving block 55*a* to 55*d* via a gear mechanism (not shown) accommodated in the support frame 51. The moving blocks 55*a* to 55*d* are independently moved in the longitudinal direction of the support frame 51 by driving of the block moving motors 56*a* to 56*d*.

Of course, the present invention is not limited to the configuration including the plurality of block moving motors 56*a* to 56*d* which independently move the plurality of moving blocks 55*a* to 55*d* respectively, as in the present embodiment. For instance, the plurality of moving blocks 55*a* to 55*d* may be mechanically connected to one block moving motor (not shown) via a gear mechanism (not shown) accommodated in the support frame 51, and the moving blocks 55*a* to 55*d* may be symmetrically moved in the longitudinal direction of the support frame 51 by driving of the one block moving motor.

Each of the moving blocks 55*a* to 55*d* has an electromagnet 57*a*, 57*b*, 57*c*, 57*d* applying a magnetic force to the steel strip S, and a distance sensor 58*a*, 58*b*, 58*c*, 58*d* for detecting a distance to the steel strip S (distance between the steel strip S and the electromagnet 57*a* to 57*d* disposed on the moving block 55*a* to 55*d*). The electromagnet 57*a* to 57*d* and the distance sensor 58*a* to 58*d* are arranged in the longitudinal direction of each moving block 55*a* to 55*d* (vertical direction; up-down direction in FIG. 2). The electromagnet 57*a* to 57*d* is disposed upstream of the distance sensor 58*a* to 58*d* in the strip feeding direction (on the side closer to the first nozzle unit 31; on the lower side in FIG. 2).

Further, as shown in FIG. 2, the support frame 51 is coupled with the first nozzle unit 31 via connection frames 51*a* disposed on both ends (both right and left ends in FIG. 2).

Thus, when the support frame 51 is moved in the horizontal plane by driving of the first frame moving motor 52, the second frame moving motor 53, and the third frame moving motor 54, the first nozzle unit 31 is moved in the horizontal plane in accordance with movement of the support frame 51 (see FIGS. 2 and 3). In addition, provision of a mechanism (not shown) for moving the first nozzle unit 31 relative to the support frame 51 enables accurate positioning of the first nozzle unit 31.

As shown in FIGS. 2 and 3, the second correction unit 42 has a support frame (second support member) 61, moving blocks 65*a*, 65*b*, 65*c*, 65*d*, electromagnets 67*a*, 67*b*, 67*c*, 67*d*, and distance sensors 68*a*, 68*b*, 68*c*, 68*d*, like the first correction unit 41.

The support frame 61 of the second correction unit 42 is mechanically connected to a first frame moving motor 62, a second frame moving motor 63, and a third frame moving motor 64, and the first frame moving motor 62, the second frame moving motor 63, and the third frame moving motor 64 are configured to move the support frame 61 in a plane (horizontal plane) perpendicular to the feeding direction of the steel strip S, like the support frame 51 of the first correction unit 41.

Further, the support frame 61 is coupled with the second nozzle unit 32 via connection frames 61*a* disposed on both ends (both right and left ends in FIG. 2). Thus, when the support frame 61 is moved in the horizontal plane by driving of the first frame moving motor 62, the second frame moving motor 63, and the third frame moving motor 64, the second nozzle unit 32 is moved in the horizontal plane in accordance with movement of the support frame 61. In addition, provision of a mechanism (not shown) for moving the second nozzle unit 32 relative to the support frame 61 enables accurate positioning of the second nozzle unit 32.

The moving blocks 65*a* to 65*d* of the second correction unit 42 are mechanically connected to block moving motors 66*a*, 66*b*, 66*c*, 66*d* respectively, and are independently moved in the longitudinal direction of the support frame 61 (strip width direction of the steel strip S), like the moving blocks 55*a* to 55*d* of the first correction unit 41.

In the present embodiment, the support frames 51, 61, the first frame moving motors 52, 62, the second frame moving motors 53, 63, the third frame moving motors 54, 64, moving blocks 55*a* to 55*d*, 65*a* to 65*d*, and the block moving motors 56*a* to 56*d*, 66*a* to 66*d* form a moving mechanism capable of moving the electromagnets 57*a* to 57*d*, 67*a* to 67*d* relative to the steel strip S. The first frame moving motor 52, 62, the second frame moving motor 53, 63, and the third frame moving motor 54, 64 can move the support frames 51, 61 in a plane perpendicular to the feeding direction of the steel strip S, and the block moving motors 56*a* to 56*d*, 66*a* to 66*d* can move the electromagnets 57*a* to 57*d*, 67*a* to 67*d* in the strip width direction of the steel strip S.

As shown in FIGS. 2 and 3, the crossbow correction device 16 is provided with edge sensors 59, 69 for detecting the position of ends of the steel strip S in the strip width direction. One edge sensor 59 is disposed on a first end (left end in FIG. 3) of the support frame 51 of the first correction unit 41. This edge sensor 59 detects a first end (left end in FIG. 3) of the steel strip S in the strip width direction. The other edge sensor 69 is disposed on a second end (right end in FIG. 3) of the support frame 61 of the second correction unit 42. This edge sensor 69 detects a second end (right end in FIG. 3) of the steel strip S in the strip width direction. That is, two edge sensors 59, 69 disposed on the first correction unit 41 and the second correction unit 42 detect both ends of the steel strip S in the strip width direction.

Of course, the present invention is not limited to the configuration including the edge sensors 59, 69, one on each support frame 51, 61 as in the present embodiment. For instance, both the edge sensor 59 for detecting a first end of the steel strip S in the strip width direction and the edge sensor 69 for detecting a second end of the steel strip S in the strip width direction may be disposed on one of the support frame 51 or the support frame 61, or may be disposed on each of the support frame 51 and the support frame 61.

Figure 4:
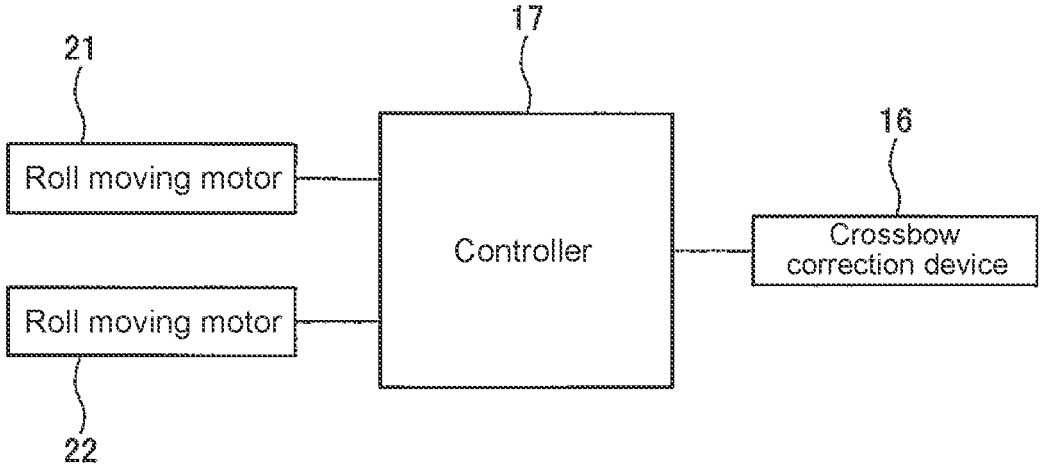
FIG. 4 is a block diagram showing operation control of correcting crossbow in a molten metal plating facility according to the first embodiment.

Further, as shown in FIG. 4, the molten metal plating facility 1 includes a controller 17 for operation control of correcting crossbow of the steel strip S. The controller 17 is electrically connected to roll moving motors 21, 22 and to the crossbow correction device 16.

More specifically, information such as current values flowing through the electromagnets 57*a* to 57*d*, 67*a* to 67*d* of the crossbow correction device 16, detection results (distances between the steel strip S and the moving blocks 55*a* to 55*d*, 65*a* to 65*d*) by the distance sensors 58*a* to 58*d*, 68*a* to 68*d*, and detection results by the edge sensors 59, 69 are send to the controller 17. On the basis of the information, the controller 17 controls driving of each of the roll moving motors 21, 22, the first frame moving motors 52, 62, the second frame moving motors 53, 63, the third frame moving motors 54, 64, and the block moving motors 56*a* to 56*d*, 66*a* to 66*d*.

The value of current flowing (supplied) to each electromagnet 57*a* to 57*d*, 67*a* to 67*d* is obtained by the controller 17 which controls operation of the electromagnet 57*a* to 57*d*, 67*a* to 67*d*. Of course, the present invention is not limited to the present embodiment. For instance, an ammeter for detecting the value of current supplied to each electromagnet may be provided.

With reference to FIGS. 1 to 7, the operation of the molten metal plating facility including the crossbow correction device according to the first embodiment of the present invention will be described.

In the plating process by the molten metal plating facility 1, the steel strip S is continuously fed by the multiple rolls (including the sink roll 12) and is immersed in the molten metal M in the plating bath 11. Thereby, the molten metal M adheres to the surface thereof (see FIG. 1).

Then, the steel strip S travels upward in the vertical direction via the sink roll 12 and the in-bath rolls 13, 14, and upon passing between the first nozzle unit 31 and the second nozzle unit 32, excess molten metal M adhering to the surface is removed.

At this time, crossbow of the steel strip S is corrected and vibration of the steel strip S is damped by the crossbow correction device 16 disposed downstream of the wiping nozzle 15 in the strip feeding direction. The operation of correcting crossbow in the molten metal plating facility 1, including the first step to fourth step shown below, is controlled by the controller 17 (see FIG. 4).

First, in the first step (second movement control), the controller 17 drives the plurality of block moving motors 56*a* to 56*d*, 66*a* to 66*d* to move the plurality of moving blocks 55*a* to 55*d*, 65*a* to 65*d* into predetermined positions, based on detection results of the edge sensors 59, 69 in a state where current is not applied to the electromagnets 57*a* to 57*d*, 67*a* to 67*d* (see FIGS. 2 to 4).

Figure 5A:
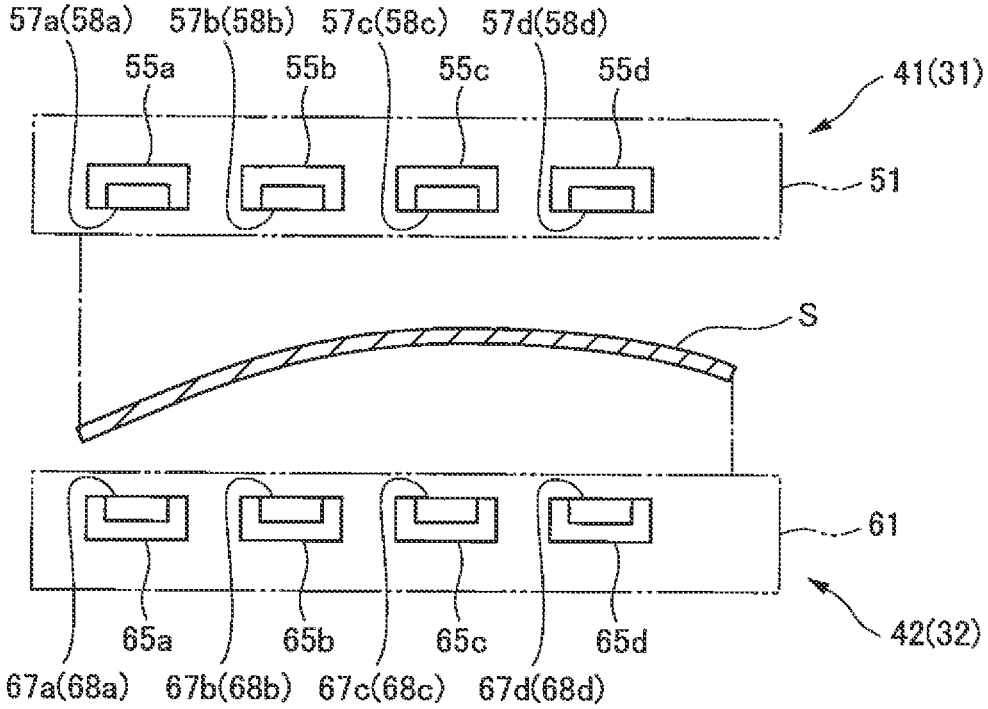
FIG. 5A is an explanatory diagram showing operation of correcting crossbow in a molten metal plating facility according to the first embodiment.
Figure 5B:
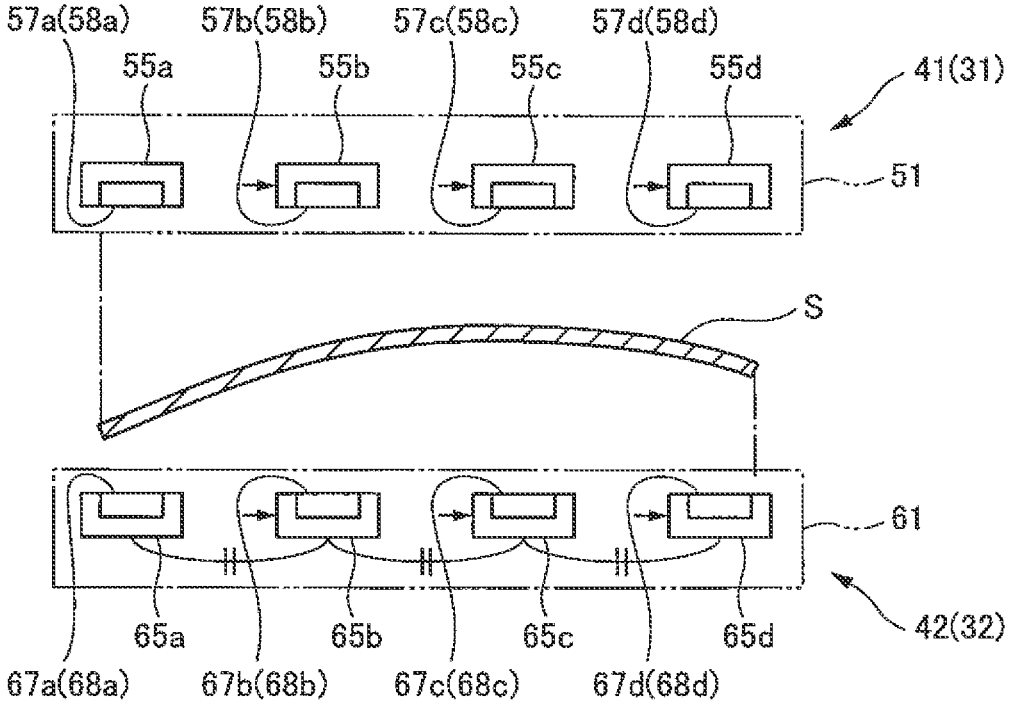
FIG. 5B is an explanatory diagram showing operation of correcting crossbow in a molten metal plating facility according to the first embodiment.

In the first step, the plurality of moving blocks 55*a* to 55*d*, 65*a* to 65*d* (electromagnets 57*a* to 57*d*, 67*a* to 67*d* and distance sensors 58*a* to 58*d*, 68*a* to 68*d*) are individually moved in the longitudinal direction of the support frames 51, 61 (strip width direction of the steel strip S), and respective two moving blocks 55*a*, 55*d*, 65*a*, 65*d* positioned on the outer side in the strip width direction of the steel strip S are disposed in the vicinity of the ends of the steel strip S in the strip width direction, and respective two moving blocks 55*b*, 55*c*, 65*b*, 65*c* positioned on the inner side in the strip width direction of the steel strip S are disposed so that the moving blocks 55*a* to 55*d*, 65*a* to 65*d* are spaced substantially equally (see FIGS. 5A and 5B).

With the first step, since magnetic forces generated by the plurality of electromagnets 57*a* to 57*d*, 67*a* to 67*d* arranged in the strip width direction efficiently act across the steel strip S in the strip width direction, in the present embodiment, it is possible to sufficiently level the steel strip S without using electromagnets 57*a* to 57*d*, 67*a* to 67*d* having a large suction force. Of course, in case of using electromagnets 57*a* to 57*d*, 67*a* to 67*d* having a sufficiently large suction force, the first step may be eliminated from the operation of correcting crossbow.

In a case where the steel strip S does not exist in a range of motion of the moving blocks 55*a* to 55*d*, 65*a* to 65*d* in the support frames 51, 61, the controller 17 drives the first frame moving motors 52, 62 to move the support frames 51, 61, based on detection results of the edge sensors 59, 69.

Accordingly, the steel strip S is caused to exist in the range of motion of the moving blocks 55*a* to 55*d*, 65*a* to 65*d* in the support frames 51, 61, and the first step can be performed.

Next, in the second step (third movement control), the controller 17 drives the second frame moving motors 53, 63 and the third frame moving motors 54, 64 to move the support frames 51, 61 into predetermined positions, based on detection results of the distance sensors 58*a* to 58*d*, 68*a* to 68*d* in a state where current is not applied to the electromagnets 57*a* to 57*d*, 67*a* to 67*d* (see FIGS. 2 to 4).

Figure 5C:
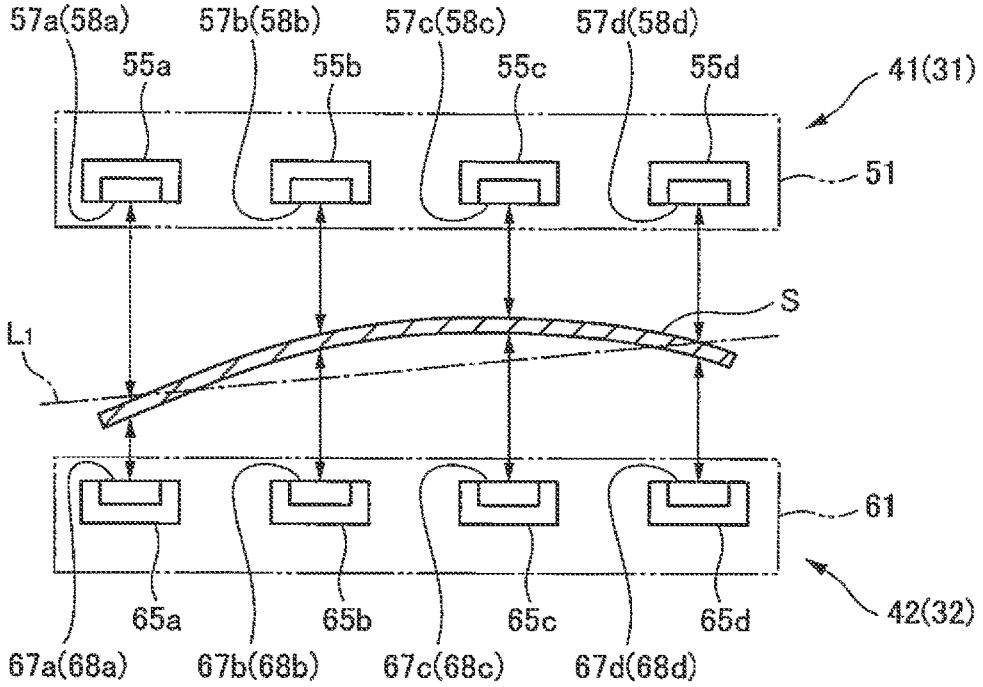
FIG. 5C is an explanatory diagram showing operation of correcting crossbow in a molten metal plating facility according to the first embodiment.

At this time, the controller 17 computes a target shape (target pass line $L_1$) of the steel strip S, based on the shape of the steel strip S (detection results of the edge sensors 59, 69 and distance sensors 58*a* to 58*d*, 68*a* to 68*d* (see FIG. 5C).

Figure 5D:
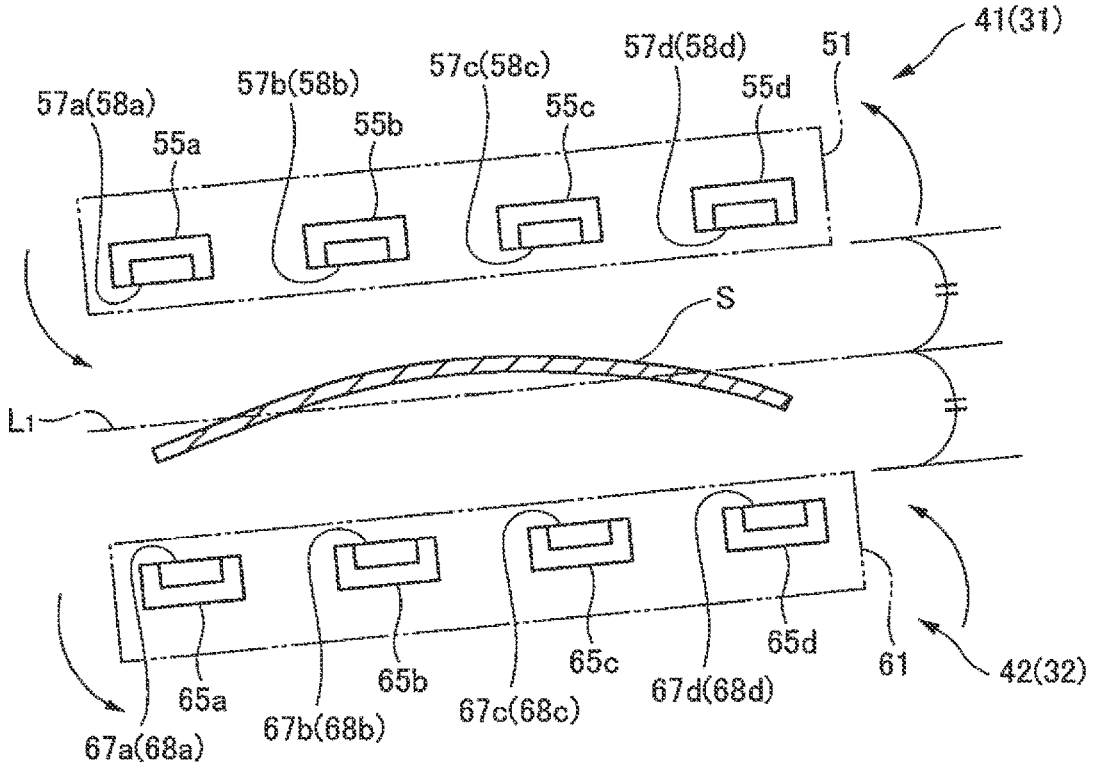
FIG. 5D is an explanatory diagram showing operation of correcting crossbow in a molten metal plating facility according to the first embodiment.

In the second step, the support frames 51, 61 (first correction unit 41, second correction unit 42, first nozzle unit 31, and second nozzle unit 32) are moved in the horizontal plane (in the strip thickness direction of the steel strip S) and positioned at a predetermined distance from the target pass line $L_1$ (see FIG. 5D). That is, the support frames 51, 61 (electromagnets 57*a* to 57*d*, 67*a* to 67*d*) are positioned parallel to the pass line (target pass line $L_1$) of the steel strip S in a range where the suction forces of the electromagnets 57*a* to 57*d*, 67*a* to 67*d* sufficiently can act on the steel strip S.

Figure 6A:
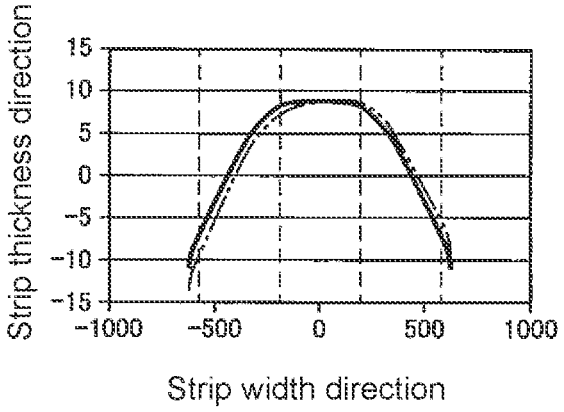
FIG. 6A is an explanatory diagram showing a positional relationship between a steel strip and electromagnets in operation of correcting crossbow in a molten metal plating facility according to the first embodiment.

With the second step, since the variation in position of the electromagnets 57*a* to 57*d*, 67*a* to 67*d* relative to the steel strip S is reduced (see FIG. 6A), in the present embodiment, it is possible to sufficiently level the steel strip S without using electromagnets 57*a* to 57*d*, 67*a* to 67*d* having a large suction force. Of course, in case of using electromagnets 57*a* to 57*d*, 67*a* to 67*d* having a sufficiently large suction force, the second step may be eliminated from the operation of correcting crossbow. Here, FIG. 6A shows the positional state of the steel strip S with respect to the target pass line $L_1$ between the first correction unit 41 and the second correction unit 42, where the long dashed double-dotted line shows the steel strip S before the second step (after the first step), and the solid line shows the steel strip S after the second step.

Next, in the third step (magnetic force control), the controller 17 operates the electromagnets 57*a* to 57*d*, 67*a* to 67*d* to correct crossbow of the steel strip S, based on detection results of the distance sensors 58*a* to 58*d*, 68*a* to 68*d* (see FIGS. 2 to 4 and 5E).

In the third step, current in accordance with the distance between the steel strip S and each electromagnet 57*a* to 57*d*, 67*a* to 67*d* is supplied to the electromagnet 57*a* to 57*d*, 67*a* to 67*d*, and suction force in accordance with (proportional to) the current value supplied to the electromagnet 57*a* to 57*d*, 67*a* to 67*d* acts on the steel strip S. More specifically, the suction force (magnetic force) of each electromagnet 57*a* to 57*d*, 67*a* to 67*d*, i.e., current value supplied to each electromagnet 57*a* to 57*d*, 67*a* to 67*d* is adjusted so that the shape of the steel strip S coincides with (approximates to) the target pass line $L_1$.

Figure 6B:
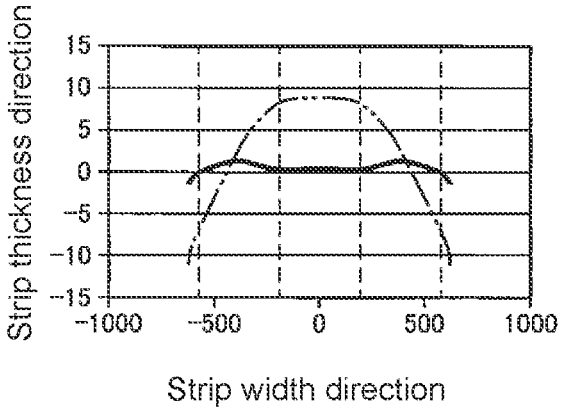
FIG. 6B is an explanatory diagram showing a relative positional relationship between a steel strip and electromagnets in operation of correcting crossbow in a molten metal plating facility according to the first embodiment.

With the third step, it is possible to appropriately correct crossbow of the steel strip (see FIG. 6B). Here, FIG. 6B shows the positional state of the steel strip S with respect to the target pass line $L_1$ between the first correction unit 41 and the second correction unit 42, where the long dashed double-dotted line shows the steel strip S before the third step (after the second step), and the solid line shows the steel strip S after the third step.

In the present embodiment, by adjusting the magnetic force of each electromagnet 57*a* to 57*d*, 67*a* to 67*d*, the steel strip S is positioned into the target pass line $L_1$, i.e., the central position between the electromagnets 57*a* to 57*d* and the electromagnets 67*a* to 67*d* which face each other (strictly, the central position between the distance sensors 58*a* to 58*d* and the distance sensors 68*a* to 68*d*).

Of course, the present invention is not limited to the present embodiment. For instance, the magnetic force of each electromagnet 57*a* to 57*d*, 67*a* to 67*d* may be adjusted in consideration of a relative positional relationship between the wiping nozzle 15 and the crossbow correction device 16, i.e., a relative positional relationship between the first and second nozzle units 31, 32 and the first and second correction units (electromagnets 57*a* to 57*d* and electromagnets 67*a* to 67*d*). More specifically, by adjusting the magnetic force of each electromagnet 57*a* to 57*d*, 67*a* to 67*d* so that the steel strip S is positioned into predetermined positions away from the central position between the electromagnets 57*a* to 57*d* and the electromagnets 67*a* to 67*d* which face each other, it is possible to reliably place the steel strip S into the central position between the first nozzle unit 31 and the second nozzle unit 32.

Further, the magnetic force of each electromagnet 57*a* to 57*d*, 67*a* to 67*d* may be adjusted in consideration of the thickness of the metal plating layer formed on the surface of the steel strip S. More specifically, by adjusting the magnetic force of each electromagnet 57*a* to 57*d*, 67*a* to 67*d* so that the steel strip S is positioned into predetermined positions away from the central position between the electromagnets 57*a* to 57*d* and the electromagnets 67*a* to 67*d* which face each other toward a side on which a thin metal plating layer is formed (e.g., a side adjacent to the electromagnets 57*a* to 57*d*), it is possible to vary the thickness of the metal plating layer formed on the surface of the steel strip S between the first surface and the second surface (front and back surfaces).

Next, in the fourth step (first movement control), the controller 17 drives the second frame moving motors 53, 63 and the third frame moving motors 54, 64 to move the support frames 51, 61, i.e., a group of the electromagnets 57*a* to 57*d* and a group of the electromagnets 67*a* to 67*d*, based on the current value supplied to each electromagnet 57*a* to 57*d*, 67*a* to 67*d* in a state where current is applied to the electromagnets 57*a* to 57*d*, 67*a* to 67*d* (see FIGS. 2 to 4).

Figure 5E:
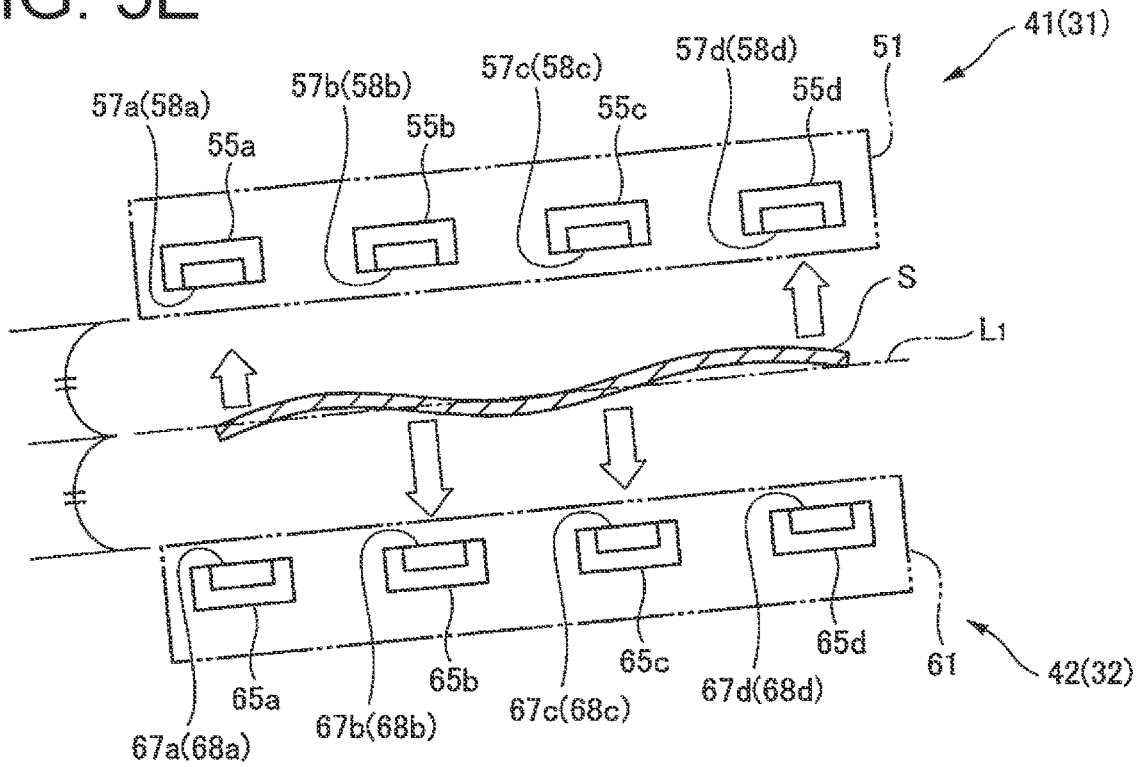
FIG. 5E is an explanatory diagram showing operation of correcting crossbow in a molten metal plating facility according to the first embodiment.
Figure 5F:
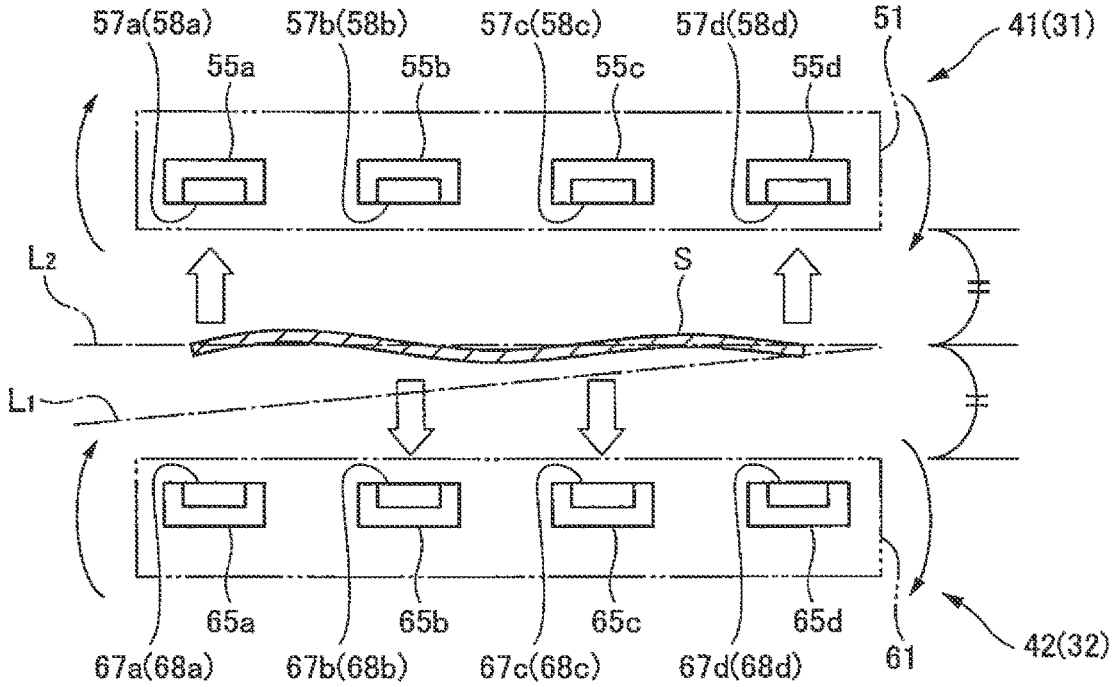
FIG. 5F is an explanatory diagram showing operation of correcting crossbow in a molten metal plating facility according to the first embodiment.

At this time, the controller 17 performs a shift control of causing translational movement of the support frames 51, 61 in a predetermined condition and a skew control of causing rotational movement of the support frames 51, 61 in a predetermined condition (see FIGS. 5E and 5F).

The shift control in the fourth step includes determining a total current value ($I_{SUM1}=I_{57a}+I_{57b}+I_{57c}+I_{57d}$) supplied to the electromagnets 57*a* to 57*d* in the first correction unit 41 and a total current value ($I_{SUM2}=I_{67a}+I_{67b}+I_{67c}+I_{67d}$) supplied to the electromagnets 67*a* to 67*d* in the second correction unit 42, and causing translational movement of the support frames 51, 61 so as to reduce a difference between these total current values ($I_{SUM1}-I_{SUM2}\approx 0$, i.e., $I_{SUM1}\approx I_{SUM2}$). $I_{57a}$ to $I_{57d}$ and $I_{67a}$ to $I_{67d}$ represent a current value supplied to each electromagnet 57*a* to 57*d*, 67*a* to 67*d*.

The skew control in the fourth step includes determining the sum ($I_{SUM3}=I_{57a}+I_{57b}+I_{67c}+I_{67d}$) of a total current value ($I_{57a}+I_{57b}$) supplied to two electromagnets 57*a*, 57*b* positioned on a first side of the center in the strip width direction of the first correction unit 41 and a total current value ($I_{67c}+I_{67d}$) supplied to two electromagnets 67*c*, 67*d* positioned on a second side of the center in the strip width direction of the second correction unit 42, and the sum ($I_{SUM4}=I_{57c}+I_{57d}+I_{67a}+I_{67b}$) of a total current value ($1_{67a}+I_{67b}$) supplied to two electromagnets 67*a*, 67*b* positioned on the first side of the center in the strip width direction of the second correction unit 42 and a total current value ($I_{57c}+I_{57d}$) supplied to two electromagnets 57*c*, 57*d* positioned on the second side of the center in the strip width direction of the first correction unit 41, and causing rotational movement of the support frames 51, 61 so as to reduce a difference between these sums ($I_{SUM3}-I_{SUM4}\approx 0$, i.e., $I_{SUM3}\approx I_{SUM4}$).

In other words, the skew control in the fourth step includes imparting rotational movement to the support frames 51, 61 so as to minimize the difference between the sum ($I_{SUM3}=I_{57a}+I_{57b}+I_{67c}+I_{67d}$) of total current values supplied to the electromagnets 57*a*, 57*b* and the electromagnets 67*c*, 67*d*, which generate tension to rotate the support frames 51, 61 in one direction (counterclockwise in FIG. 5E, for instance) around the longitudinal center of the support frames 51, 61, and the sum ($I_{SUM4}=I_{57c}+I_{57d}+I_{67a}+I_{67b}$) of total current values supplied to the electromagnets 57*c*, 57*d* and the electromagnets 67*a*, 67*b*, which generate tension to rotate the support frames 51, 61 in the other direction (clockwise in FIG. 5E, for instance) around the longitudinal center of the support frames 51, 61.

In the fourth step, by combining the shift control and the skew control, the support frames 51, 61 (first correction unit 41, second correction unit 42, first nozzle unit 31, and second nozzle unit 32) are moved in the horizontal plane so that the electromagnets 57*a* to 57*d*, 67*a* to 67*d* have substantially the same (uniform) load (suction force), and thereby the steel strip S is moved from the aforementioned target pass line $L_1$ into a new pass line $L_2$ (see FIGS. 5E and 5F).

Of course, the present invention is not limited to the configuration in which the steel strip S is finally moved into a new pass line $L_2$ by moving the support frames 51, 61 while monitoring the current values $I_{57a}$ to $I_{57d}$, $I_{67}a$ to $I_{67}d$ flowing through the electromagnets 57*a* to 57*d*, 67*a* to 67*d*, as in the present embodiment. For instance, a relationship between the change of current values $I_{57a}$ to $I_{57}d$, $I_{67a}$ to $I_{67d}$ flowing through the electromagnets 57*a* to 57*d*, 67*a* to 67*d* and the displacement amount of the pass line (feeding position) of the steel strip S may be formulated or stored as data in advance; a new target pass line $L_2$ for equalizing the loads (suction forces) of the electromagnets 57*a* to 57*d*, 67*a* to 67*d* may be computed in advance (after the third step) based on the current values $I_{57a}$ to $I_{57d}$, $I_{67a}$ to $I_{67d}$ flowing through the electromagnets 57*a* to 57*d*, 67*a* to 67*d* at a certain time point; and the support frames 51, 61 may be moved into positions at a predetermined distance from the computed target pass line $L_2$.

Figure 7:
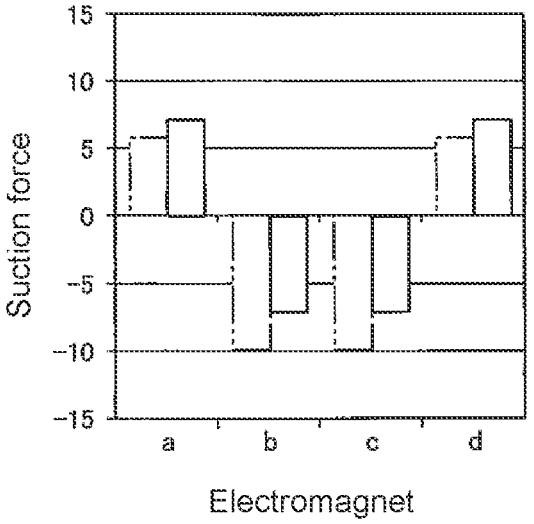
FIG. 7 is an explanatory diagram showing a relationship of the suction forces of electromagnets in operation of correcting crossbow in a molten metal plating facility according to the first embodiment.

With the fourth step, it is possible to equalize and reduce the suction forces of the electromagnets 57*a* to 57*d*, 67*a* to 67*d*, i.e., the current values supplied to the electromagnets 57*a* to 57*d*, 67*a* to 67*d* (see FIG. 7). Here, FIG. 7 shows the suction force of each electromagnet 57*a* to 57*d*, 67*a* to 67*d* (in FIG. 7, "a" represents 57*a*, 67*a*, "b" represents 57*b*, 67*b*, "c" represents 57*c*, 67*c*, and "d" represents 57*d*, 67*d*) disposed in the strip width direction of the steel strip S, where the long dashed double-dotted line shows the suction force of each electromagnet 57*a* to 57*d*, 67*a* to 67*d* before the fourth step (after the third step), and the solid line shows the suction force of each electromagnet 57*a* to 57*d*, 67*a* to 67*d* after the fourth step.

In the fourth step, while performing the shift control and the skew control, the controller 17 adjusts the magnetic force of each electromagnet 57*a* to 57*d*, 67*a* to 67*d* based on detection results of the distance sensors 68*a*, 68*b*, 68*c*, 68*d* and controls the steel strip S so as to be placed at a predetermined position between the electromagnets 57*a* to 57*d* and the electromagnets 67*a* to 67*d* which face each other, and the current values $I_{57a}$ to $I_{57d}$, $I_{67a}$ to $I_{67d}$ supplied to the electromagnets 57*a* to 57*d*, 67*a* to 67*d* change in accordance with movement (translational movement and rotational movement) of the support frames 51, 61.

Accordingly, the first nozzle unit 31 and the second nozzle unit 32 are moved together with the support frames 51, 61 while keeping a predetermined distance from the steel strip S. Thus, it is possible to appropriately remove excess molten metal M adhering to the surface of the steel strip S by the first nozzle unit 31 and the second nozzle unit 32, and to form the metal plating layer with a desired thickness, without changing the distance of the first nozzle unit 31 and the second nozzle unit 32 from the steel strip S (see FIGS. 2 to 4).

In the present embodiment, by adjusting the magnetic force of each electromagnet 57*a* to 57*d*, 67*a* to 67*d*, the steel strip S is positioned into the target pass line $L_1$ (see the fourth step), i.e., the central position between the electromagnets 57*a* to 57*d* and the electromagnets 67*a* to 67*d* which face each other (strictly, the central position between the distance sensors 58*a* to 58*d* and the distance sensors 68*a* to 68*d*).

Of course, the present invention is not limited to the present embodiment. For instance, the magnetic force of each electromagnet 57*a* to 57*d*, 67*a* to 67*d* may be adjusted in consideration of a relative positional relationship between the wiping nozzle 15 and the crossbow correction device 16, i.e., a relative positional relationship between the first and second nozzle units 31, 32 and the first and second correction units (electromagnets 57*a* to 57*d* and electromagnets 67*a* to 67*d*) or the thickness of the metal plating layer formed on the surface of the steel strip S.

The crossbow correction method according to the present invention is not limited to the operation of the crossbow correction device 16 described above and may include a fifth step (roll movement control) of moving the roll disposed upstream of the electromagnets in the strip feeding direction, based on the current value flowing through the electromagnets. That is, the operation of correcting crossbow in the molten metal plating facility 1 may include, in addition to the first step to the fourth step, the following fifth step.

In the fifth step (roll movement control), the controller 17 drives the roll moving motors 21, 22 to move the in-bath rolls 13, 14, based on the current values supplied to the electromagnets 57*a* to 57*d*, 67*a* to 67*d* in a state where current is applied to the electromagnets 57*a* to 57*d*, 67*a* to 67*d* (see FIG. 2).

In the fifth step, the in-bath rolls 13, 14 is moved toward and away from the steel strip S by driving of the roll moving motors 21, 22 and positioned so as to further reduce the equalized load (suction force) of each electromagnet 57*a* to 57*d*, 67*a* to 67*d*.

With the fifth step, since the load (suction force) of each electromagnet 57*a* to 57*d*, 67*a* to 67*d* substantially equalized in the first step to fourth step is further reduced, it is possible to more efficiently correct crossbow of the steel strip by the electromagnets 57*a* to 57*d*, 67*a* to 67*d*.

In the fifth step, while controlling the operation of the in-bath rolls 13, 14 and the roll moving motors 21, 22, the controller 17 adjusts the magnetic force of each electromagnet 57*a* to 57*d*, 67*a* to 67*d* based on detection results of the distance sensors 68*a*, 68*b*, 68*c*, 68*d* and controls the steel strip S so as to be placed at a predetermined position between the electromagnets 57*a* to 57*d* and the electromagnets 67*a* to 67*d* which face each other, and the current values supplied to the electromagnets 57*a* to 57*d*, 67*a* to 67*d* change in accordance with movement of the in-bath rolls 13, 14.

Accordingly, the first nozzle unit 31 and the second nozzle unit 32 are moved together with the support frames 51, 61 while keeping a predetermined distance from the steel strip S. Thus, it is possible to appropriately remove excess molten metal M adhering to the surface of the steel strip S by the first nozzle unit 31 and the second nozzle unit 32, and to form the metal plating layer with a desired thickness, without changing the distance of the first nozzle unit 31 and the second nozzle unit 32 from the steel strip S (see FIGS. 2 to 4).

Of course, the present invention is not limited to the configuration in which the steel strip S is finally moved into a new pass line by moving the in-bath rolls 13, 14 while monitoring the current values flowing through the electromagnets 57*a* to 57*d*, 67*a* to 67*d*, as described above. For instance, a new target pass line for equalizing the loads (suction forces) of the electromagnets 57*a* to 57*d*, 67*a* to 67*d* may be computed in advance (after the fourth step), and the in-bath rolls 13, 14 may be moved so that the steel strip S coincides with the computed target pass line.

The functions and effects of the present embodiment described above will be compared with prior arts, in conjunction with the characteristics of steel strips.

Generally, a steel strip fed continuously in a facility for producing a steel strip has a characteristic of moving (translating or rotating) in the strip thickness direction with the change of the type of steel and operational conditions, and with the operation of correcting crossbow.

In the prior arts, the translating or rotating steel strip is leveled by the magnetic force of an electromagnet, i.e., crossbow is corrected while movement of the steel strip is restricted by the magnetic force of an electromagnet. Thus, the electromagnet requires not only correction force of correcting crossbow of the steel strip but also restriction force of restricting movement of the steel strip. Therefore, a large load, i.e., current value, is applied to the electromagnet.

By contrast, in the present embodiment, since the electromagnet 57*a* to 57*d*, 67*a* to 67*d* is (translationally or rotationally) moved based on the current value flowing through the electromagnet 57*a* to 57*d*, 67*a* to 67*d*, it is possible to observe movement of the steel strip S based on the current value flowing through the electromagnet 57*a* to 57*d*, 67*a* to 67*d*, and it is possible to move the electromagnet 57*a* to 57*d*, 67*a* to 67*d* in accordance with movement of the steel strip S. That is, crossbow is corrected while movement of the steel strip S is allowed. Thus, the electromagnet 57*a* to 57*d*, 67*a* to 67*d* requires only correction force of correcting crossbow of the steel strip S and does not require restriction force of restricting movement of the steel strip S. Therefore, it is possible to reduce the load, i.e., current value applied to the electromagnet 57*a* to 57*d*, 67*a* to 67*d*.

In the prior arts, since crossbow is corrected while movement of the steel strip is restricted, the steel strip is conveyed in a constant position (pass line) relative to the molten metal plating facility (ground). By contrast, in the present embodiment, since crossbow is corrected while movement of the steel strip S is allowed, the steel strip S is conveyed while moving relative to the molten metal plating facility 1 (ground), i.e., while the pass line is changed.

REFERENCE SIGNS LIST

1 Molten metal plating facility
11 Plating bath
12 Sink roll
13, 14 In-bath roll
15 Wiping nozzle
16 Crossbow correction device
17 Controller
21, 22 Roll moving motor
31 First nozzle unit
32 Second nozzle unit
41 First correction unit
42 Second correction unit
51 Support frame of first correction unit (Moving mechanism, First support member)
51*a* Connection frame of first correction unit
52 First frame moving motor of first correction unit (Moving mechanism)
53 Second frame moving motor of first correction unit (Moving mechanism)
54 Third frame moving motor of first correction unit (Moving mechanism)
55*a* to 55*d* Moving block of first correction unit (Moving mechanism)
56*a* to 56*d* Block moving motor of first correction unit (Moving mechanism)
57*a* to 57*d* Electromagnet of first correction unit
58*a* to 58*d* Distance sensor of first correction unit (Distance detector)
59 Edge sensor of first correction unit
61 Support frame of second correction unit (Moving mechanism, second support member)
61*a* Connection frame of second correction unit
62 First frame moving motor of second correction unit (Moving mechanism)
63 Second frame moving motor of second correction unit (Moving mechanism)
64 Third frame moving motor of second correction unit (Moving mechanism)
65*a* to 65*d* Moving block of second correction unit (Moving mechanism)
66*a* to 66*d* Block moving motor of second correction unit (Moving mechanism)
67*a* to 67*d* Electromagnet of second correction unit
68*a* to 68*d* Distance sensor of second correction unit (Distance detector)
69 Edge sensor of second correction unit

The invention claimed is:

1. A crossbow correction device for correcting crossbow of a steel strip by a magnetic force during conveyance, comprising:

a plurality of electromagnets arranged in a strip width direction of the steel strip and facing each other so as to sandwich the steel strip in a strip thickness direction;

a mover extending along an entire width of the steel strip and configured to move the electromagnets relative to the steel strip; and a controller configured to operate the mover, based on a current value flowing through the electromagnets, wherein the mover includes a first support member supporting an electromagnet disposed on a first side in the strip thickness direction of the steel strip and a second support member supporting an electromagnet disposed on a second side in the strip thickness direction of the steel strip among the plurality of electromagnets, and the first support member and the second support member are each movable in a plane perpendicular to a feeding direction of the steel strip, wherein the controller is configured to cause a rotational movement of the first support member as a single unit and the second support member as a single unit, individually, the crossbow correction device further comprising a distance detector for detecting a distance between the steel strip and each of the plurality or electromagnets, wherein the controller is configured to adjust respective magnetic forces of the plurality of electromagnets based on a detection result of the distance detector, and the controller is configured to operate the mover based on the current value flowing through the plurality of electromagnets, and wherein the controller is configured to perform control so as to reduce a difference between a first sum and a second sum, where the first sum is a sum of a total current value flowing through the electromagnet supported by the first support member and positioned on a first side of a center in the strip width direction of the steel strip and a total current value flowing through the electromagnet supported by the second support member and positioned on a second side of the center in the strip width direction of the steel strip, and the second sum is a sum of a total current value flowing through the electromagnet supported by the second support member and positioned on the first side of the center in the strip width direction of the steel strip and a total current value flowing through the electromagnet supported by the first support member and positioned on the second side of the center in the strip width direction of the steel strip.

2. The crossbow correction device according to claim 1, wherein the controller is configured to cause translational movement of the first support member and the second support member individually, and wherein the controller is configured to perform control so as to reduce a difference between a total current value flowing through the electromagnet supported by the first support member and a total current value of the electromagnet supported by the second support member.

3. The crossbow correction device according to claim 1, further comprising:

a strip end detector for detecting a position of an end of the steel strip in the strip width direction, wherein the mover is configured to move the electromagnet supported by the first support member and the electromagnet supported by the second support member in the strip width direction of the steel strip individually, and wherein the controller is configured to operate the mover, based on a detection result of the strip end detector.

4. The crossbow correction device according to claim 1, wherein the controller is configured to operate the mover, based on a detection result of a distance detector, in a state where current is not applied to the plurality of electromagnets.

5. A molten metal plating facility comprising:

a wiping nozzle for spraying a gas to a steel strip; and a crossbow correction device for correcting crossbow of the steel strip by a magnetic force during conveyance, wherein the crossbow correction device is the crossbow correction device according to claim 1, and wherein the wiping nozzle is configured to move together with the plurality of electromagnets in the strip thickness direction of the steel strip.

6. A crossbow correction method for correcting crossbow of a steel strip by a magnetic force during conveyance, comprising:

arranging a first plurality of electromagnets in a strip width direction on a first mover extending along an entire width of the steel strip on a first side of the steel strip in a strip thickness direction, and arranging a second plurality of electromagnets in the strip width direction on a second mover extending along the entire width of the steel strip on a second side of the strip in the thickness direction, while the first and second plurality of electromagnets face each other so as to sandwich the steel strip in a strip thickness direction, and moving the first and second plurality of electromagnets relative to the steel strip in plane perpendicular to a feeding direction of the steel strip, based on a current value flowing through the first and second plurality of electromagnets, wherein the moving step includes causing a rotational movement of the first mover as a unit and a rotational movement of the second mover as a unit, individually, the crossbow correction method further comprising:

a magnetic force control of adjusting respective magnetic forces of the first and second plurality of electromagnets, based on a distance between the steel strip and each of the first and second plurality of electromagnets; and a first movement control of moving the first plurality of electromagnets and the second plurality of electromagnets, wherein the first movement control includes causing the rotational movement of the first mover and causing the rotational movement of the second mover so as to reduce a difference between a first sum and a second sum, where the first sum is a sum of a total current value flowing through a part of the first plurality of electromagnets positioned on a first side of a center in the strip width direction of the steel strip and a total current value following through a part of the second plurality of electromagnets positioned on a second side of the center in the strip width direction of the steel strip, and the second sum is a sum of a total current value flowing through the other part of the second plurality of electromagnets positioned on the first side of the center in the strip width direction of the steel strip and a total current value flowing through the other part of the first plurality of electromagnets positioned on the second side of the center in the strip width direction of the steel strip.

7. The crossbow correction method according to claim 6, wherein the first movement control includes causing translational movement of the first plurality of electromagnets disposed on the first side in the strip thickness direction of the steel strip and the second plurality of electromagnets disposed on the second side in the strip thickness direction of the steel strip so as to reduce a difference between a total current value flowing through the first plurality of electromagnets disposed on the first side in the strip thickness direction of the steel strip and a total current value flowing through the second plurality of electromagnets disposed on the second side in the strip thickness direction of the steel strip.

8. The crossbow correction method according to claim 6, further comprising:

a second movement control of moving each of the first and second plurality of electromagnets in the strip width direction of the steel strip, based on a position of an end of the steel strip in the strip width direction, in a state where current is not applied to the first and second plurality of electromagnets; and a third movement control of moving each of the first and second plurality of electromagnets in the strip thickness direction of the steel strip, based on a distance between the steel strip and each of the first and second plurality of electromagnets, in a state where current is not applied to the plurality of first and second electromagnets.

9. The crossbow correction method according to claim 6, further comprising:

a roll movement control of moving a roll disposed upstream of the first and second plurality of electromagnets in the feeding direction of the steel strip based on the current value flowing through the first and second plurality of electromagnets.

* * * * *